US005146132A

United States Patent [19]

Capek

[11] Patent Number: 5,146,132

[45] Date of Patent: Sep. 8, 1992

[54] CRT FRONT PANEL WITH CONTROLLED CONFIGURATION

[75] Inventor: Raymond G. Capek, Elmhurst, Ill.

[73] Assignee: Zenith Electronics Corporation, Glenview, Ill.

[21] Appl. No.: 634,270

[22] Filed: Dec. 26, 1990

[51] Int. Cl.[5] ..... H01J 29/07; H01J 29/86

[52] U.S. Cl. ..... 313/407; 313/477 R

[58] Field of Search ..... 313/477 R, 407

[56] References Cited

U.S. PATENT DOCUMENTS 4,737,681 4/1988 Dietch et al. ..... 313/407 X 4,779,023 10/1988 Strauss ..... 313/407 X

FOREIGN PATENT DOCUMENTS 0135553 8/1983 Japan ..... 313/477 R

*Primary Examiner*—Palmer C. DeMeo

*Attorney, Agent, or Firm*—Roland W. Norris

[57] ABSTRACT

A means for attaining a predetermined CRT front panel configuration is disclosed as being particularly suitable for use with tensioned-mask CRTs having mask support means affixed to the front panel. A ceramic rail or the like is affixed to the front panel in opposition to the mask support to produce panel deformation forces counteracting those produced by the mask supports. In one embodiment, the panel is deformed more than is ultimately desired and the deformation structures are then ground to produce the desired panel configuration. Repeatability of screen curvature is thereby attained, allowing for interchangeable shadow mask and screen construction of the CRT.

10 Claims, 5 Drawing Sheets

CRT FRONT PANEL WITH CONTROLLED CONFIGURATION

This application is related to, but in no way dependent upon the following applications: U.S. patent application Ser. No. 07/458,129 and Ser. No. 07/685,352; filing date, Apr. 15, 1991, now U.S. Pat. No. 5,086,251, issue date, Feb. 2, 1992, commonly owned herewith.

BACKGROUND OF THE INVENTION

1. Field of the Invention

The present invention relates to means for repeatably attaining the desired configuration of a cathode ray tube (CRT) front panel, or faceplate, of the tensioned mask type. Such CRTs may have the shadow mask mounting means affixed directly to the CRT panel. The CRT panel also carries the image forming screen of the CRT, which is, generally, a matrix of phosphor elements.

There have been proposed a variety of ways and means for making CRTs having interchangeable screens and shadow masks in order to simplify the manufacture thereof. However, any interchangeable system requires that the standard screen matrix be reproducibly positioned on each faceplate so as to register with any standard shadow mask. It will be remembered that the shadow mask apertures and the phosphor elements must register, i.e. be in operational alignment, for a suitable image to be formed on the screen. It follows that the substrates onto which the screen matrices are deposited, i.e. the screening surface of the CRT panels, must have a consistent configuration.

2. Discussion of the Related Art

As previously noted, tensioned mask CRTs may have the mask mounting means affixed to the faceplate. While this construction affords a multiplicity of advantages, certain problems concerning panel glass strain are attendant therewith. An improved system for affixing the mask mounting means is disclosed in the above-cited related U.S. patent application, Ser. No. 07/458,129, now U.S. Pat. No. 5,086,251, issue date, Feb. 2, 1992. Therein, the coefficients of thermal expansion (or contraction, if preferred, hereinafter CTE) of the mask mounting means, sometimes referred to as rails, and the panel glass are deliberately mismatched, with the mask mounting CTE being lower than the glass CTE to provide the panel assembly, i.e., the panel with its attached mask mounting means; with resistance to damage from thermal processing.

However, as is evident from FIG. 5 of that disclosure, included herein as FIG. 1, the panel assembly is distorted from its there desired flat shape by the disclosed system, resulting in a panel assembly distorted convexly toward the screening surface, as seen in FIG. 4.

Such distortion is not desirable where the registration and proper operation of an interchangeable mask and screen would be predicated upon the geometries of a planar panel assembly whose screening surface is flat to within, e.g., plus or minus one-quarter of a mil (0.00025 inches). It will be appreciated by the artisan that a cylindrical panel assembly utilizing a tensioned mask would have much the same requirements for repeatability of the desired geometry.

Therein lies a desiderata for such panel assemblies which are resistant to thermal shock and, as well, provide a repeatable configuration for the application of the phosphor screen.

OBJECTS OF THE INVENTION

It is an object of the invention to provide CRT panels having repeatable screening surface configuration so as to improve the manufacture and performance of tensioned mask cathode ray tubes.

Other attendant advantages will be more readily appreciated as the invention becomes better understood by reference to the following detailed description and compared in connection with the accompanying drawings, in which like reference numerals designate like parts throughout the figures. It will be appreciated that the drawings may be exaggerated for explanatory purposes

DESCRIPTION OF THE PREFERRED EMBODIMENTS

Figure 2:
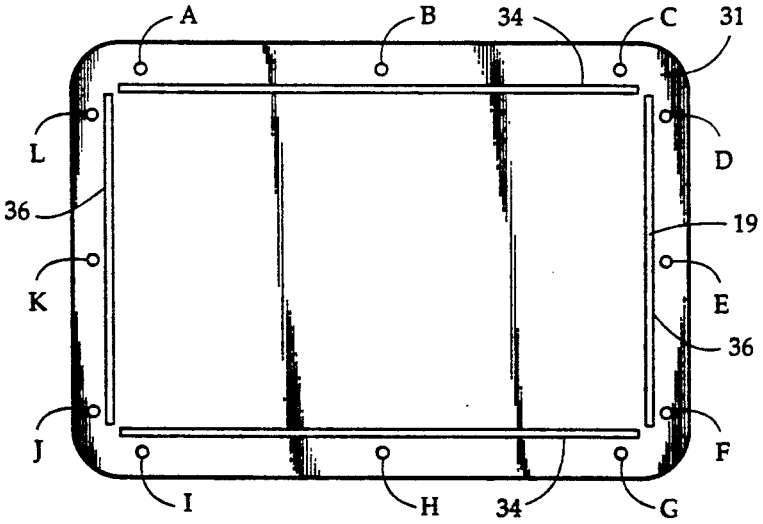
FIG. 2 is plan view of a preferred tensioned mask CRT panel showing of mask mounting means attached hereto and having twelve panel measuring points labeled thereon
Figure 3:
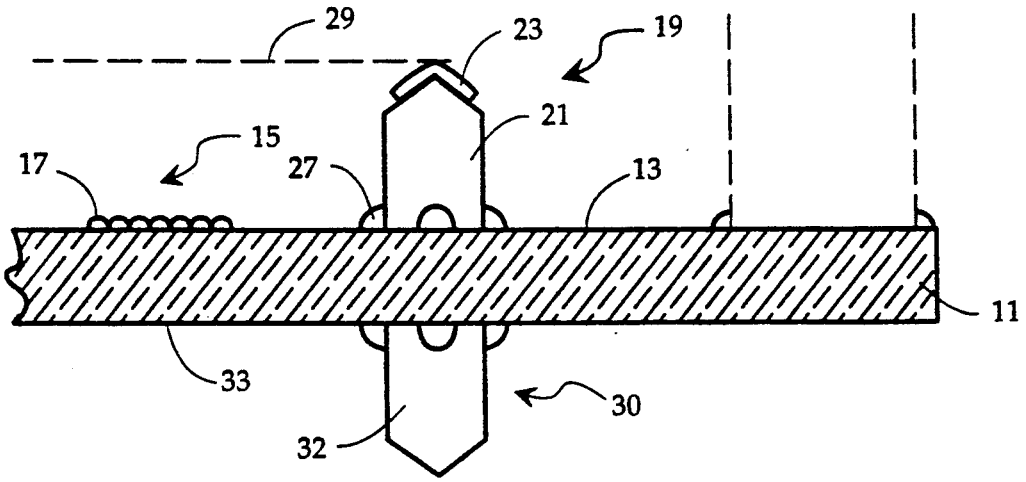
FIG. 3 is a sectional view of a CRT panel with mask support means and distortion counteracting rails attached to opposite sides of the panel.

As seen in FIG. 3, a section of a flat faceplate, or CRT front panel 11 is composed of glass. The panel 11 has an inner surface 13 which has deposited thereon a screen 15 comprised of a matrix of phosphor elements 17. Affixed to the inner surface 13 is mask support means 19 preferably comprising a ceramic rail 21 with a metal strip or cap 23. Four such mask support means 19 would ordinarily be applied to the panel 11 in a rectangular array, as seen in FIG. 2. The ceramic rail 21 is cemented at its base 25 to the panel 11 by means of a known devitrifying frit 27 which turns solid at high temperatures, as described in the above-cited, co-owned application Ser. No. 07/458,129. Affixed to the metal cap 23 by welding or the like, in an operational color CRT is a tensioned foil shadow mask 29. A distortion counteracting, or strain inducing, means 30 shown as a ceramic rail 32 is attached, according to one embodiment of the present invention, on the outer surface 33 of the panel 11, in order to balance or over-balance the deformation forces applied to the panel by mask support means 19, as further explained below.

The preferred mask support means 19, as described in S/N: 07/458,129, has a coefficient of thermal expansion (CTE) lower than that of the panel glass. This is intentionally done to produce favorable residual stresses at the rail ends 31 to improve thermal cycling throughput during manufacture. As a related effect, the inner surface 13 of the panel 11 deforms, or distorts, convexly as graphed in FIG. 1. This will be denominated an inward or positive deflection.

Figure 1:
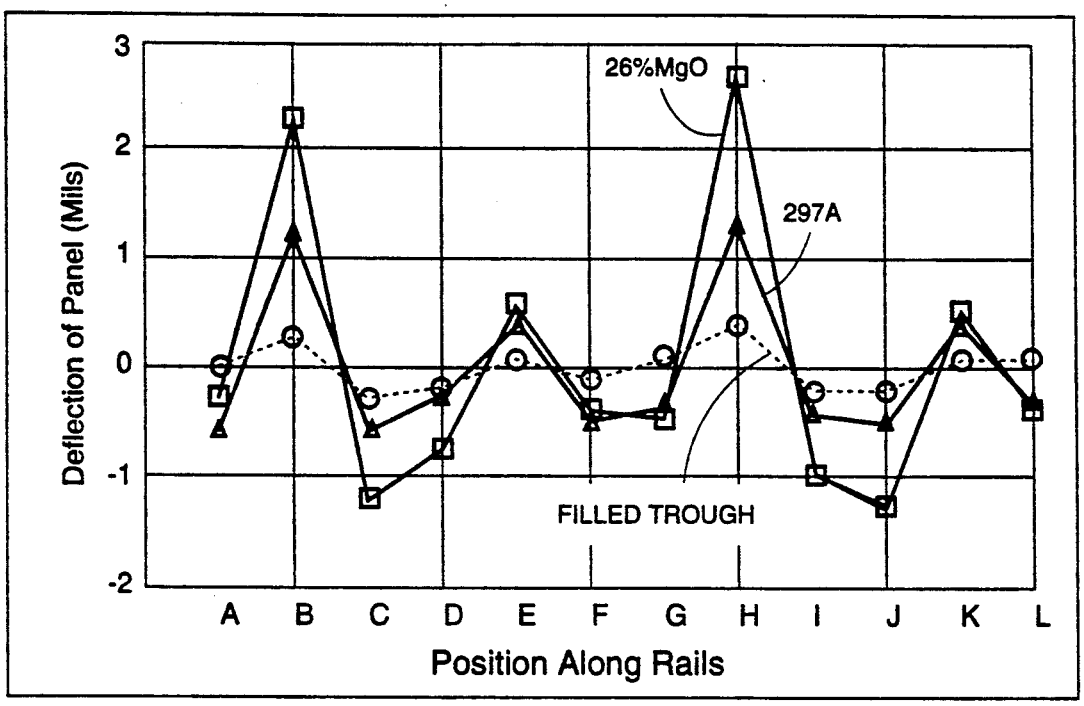
Fig. 1 (PRIOR ART)
FIG. 1 is graph of panel distortion when utilizing mask mounting means whose CTE is mismatched with that of the panel glass.
Figure 4:
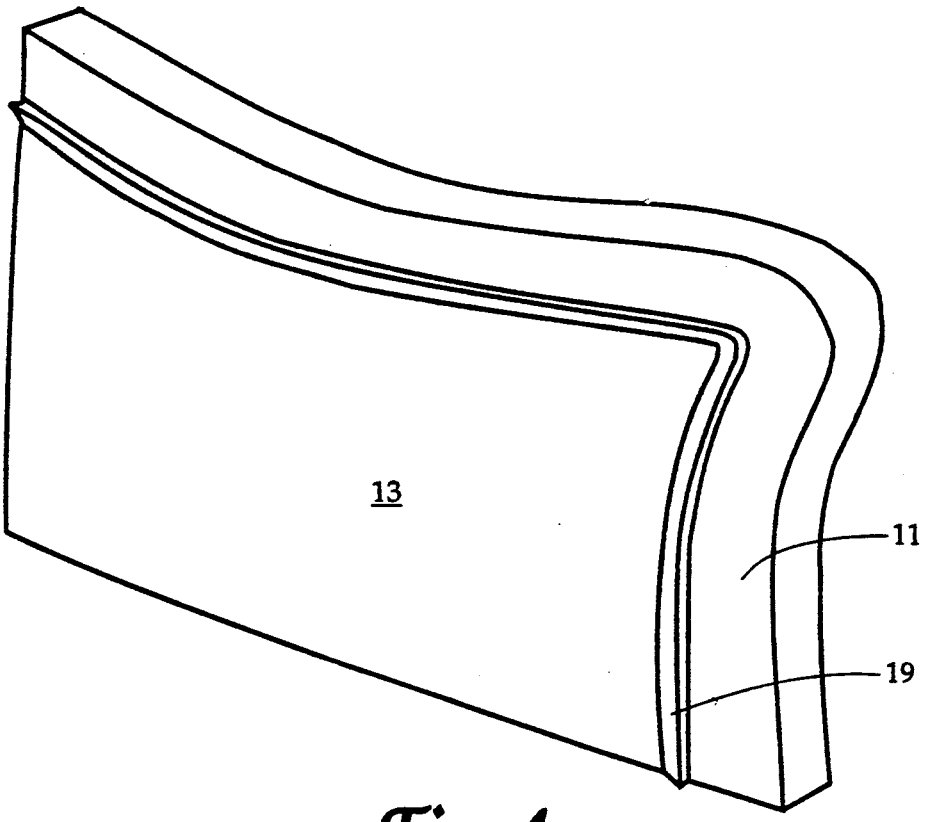
FIG. 4 is a perspective view of an undesirable distorted panel.

As seen in FIG. 4, and with reference to the labeled positions of FIG. 2, a rendering of the graph of FIG. 1 shows that the panel 11 has domed with the greatest inward deflection being in the middle of the long rails 34, at B and H, with the next greatest inward deflections being in the middle of the short rails 36, at E and K. Outward or negative deflection occurs at the corners of the panel 11, i.e., at A, L; C,D; F,G; and I,J.

As seen in FIG. 3, an uncapped ceramic rail 32 having a shape and size substantially similar to the ceramic mask support rail 21 is affixed by frit 27 on the outside panel surface 33 at a point opposite the support rail 21. However, in order to over-balance the panel deformation induced by the mask support rails 19, the counter-rail 32 is composed of a ceramic having a lower percentage of magnesia. Such a ceramic will have a lower CTE than the mask rail 21 and, therefore, induce more strain, and hence more deformation, into the panel 11. The current preferred composition of the mask support ceramic rails formula designation No. 297A is 28% magnesia, 62% talc, 6% barium carbonate and 4% ball clay. The counter-rail 32 will be considered hereinafter as having only a 26% magnesia content although various lower magnesia contents may be suitably used. Counter-rails having twenty-two percent magnesia have been found to spall the panel. As the percentage of magnesia decreases, the talc percentage is increased.

Figure 5:
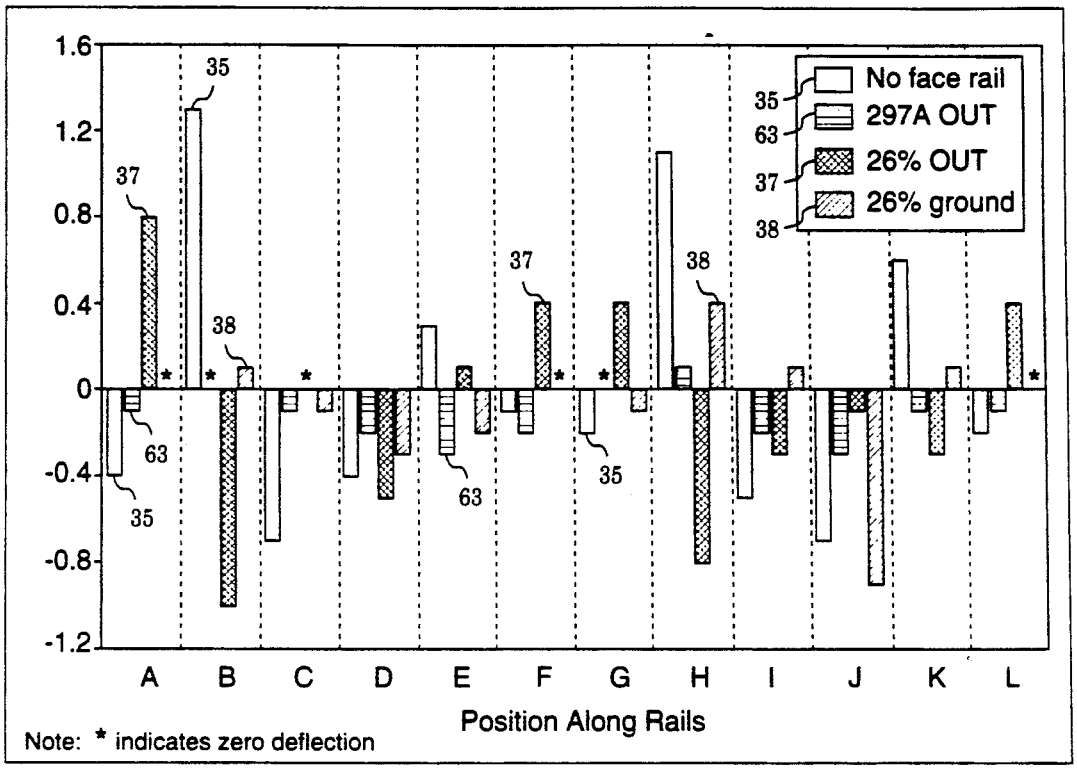
FIG. 5 is a graph showing the distortional effects of mask support rails, counteracting rails, and ground counteracting rails.

Referring now to the graph of FIG. 5, deflection along the rails with only mask support means 19 applied to the inner surface 13 of the panel 11 is represented buy the first bars 35. It can be seen from the first bars 35 that the highest inward deviation is about 1.3 mils and the highest outward deviation is about 0.7 mils for a total of about 2.0 mils. The third bars 37 represent deflection along the rails with both the mask support means 19 applied to the panel inner surface 13 and the distortion counteracting means 30, at 26% magnesia content, applied to the panel outside surface 33, as per FIG. 3, resulting in a panel distorted in a direction opposite that of line 35. It can be seen on line 37 that the highest inward deviation is about 0.8 mils and the highest outward deviation is about 0.9 mils for a total of about 1.7 mils. The fourth bars 38 shows the effects of removing mass from the counter rail 32 by grinding the rails from a 0.260 inch height to a 0.080 inch height. Therein, the highest outward deviation is about 0.9 mils, for a total of about 1.3 mils. This illustrates the effect of removing too much material from the counter-rails.

As can be seen the panel has, after the grinding of the counterrail to 0.080 inches resumed the inward deflection of the panel due to strain from the mask support rails, but to a lesser degree, owing to the counterbalancing strain of the remaining counter rail mass. The amount of reduction in panel deflection from the over-warped state to the "normal", or planar, state by removal of a given mass from the counter rail is predictable though not necessarily linear, and will depend upon the composition of the counter rail, its placement, and its mismatch with the strain induced by the mask support rail. Total panel deflection in the 0.4 mil range has been attained experimentally, starting with glass in the 1.3 mil range of deflection.

Referring again to the graph of FIG. 5, the second bars 63 represents deflection along the rails with both the mask support means 19 applied to the panel inner surface 13 and the distortion counteracting means 30 of formula 297A, ie. 28% magnesia, applied to the panel outside surface 33, as per FIG. 3, without additional grinding. It can be seen from the second bars 63 that the highest inward deviation is about 0.2 mils and the highest outward deviation is about 0.3 mils, for a total of about 0.5 mils. Thus, by applying the distortion counteracting means 30 to the panel 11, the rail-strains distorting the panel are more balanced and a much flatter panel is obtained. Accordingly, the panel inner surface 13 is more nearly the shape intended for the application of a standard screen thereto. It will be noted that this flatter panel is also less susceptible to strain from atmospheric loading during evacuation of the CRT envelope.

It will be appreciated that the described arrangement does not exactly balance the panel distorting forces. For example, the support means has a metal rail cap 23 attached, whereas the distortion compensation means does not, leading to some mismatch in the tensile forces applied to the glass beneath each rail. By careful selection of the uncapped rail 32 composition, size, and placement, further reductions in panel distortion may be possible through a more complete balancing of the distortion forces applied by the mask supports. For example, the uncapped compensating rail 32, if placed on the panel outer surface 33, may be moved closer to the edge of the panel outer surface 33, and/or reduced in size, to be more easily hidden beneath a covering plate, or bezel, (not shown) commonly used with CRTs. In such a case, the magnesia content of the compensating ceramic composition may be decreased, e.g. to 24 or 26 percent, to lower the CTE of the compensating means 30 and provide additional counteracting tensile forces since the compensating rail 32 will not be directly beneath or opposite the mask supports 19.

Figure 6:
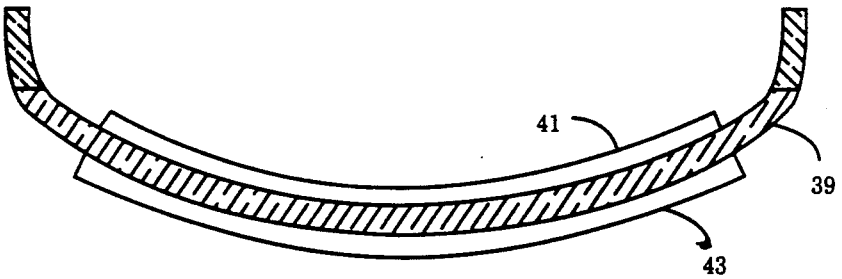
FIG. 6 is a cross sectional view of a CRT cylindrical faceplate and funnel with a counteracting rail attached thereto.

As shown in FIG. 6, other faceplate configurations capable of utilizing a tensioned shadow mask, such as a cylindrical faceplate 39 with curved mask supports 41 attached thereto, may utilize compensating rails 43 according to the present invention, to maintain the desired radius of curvature of the panel upon application of the mask supports 41, with panel-to-panel consistency.

Figure 7:
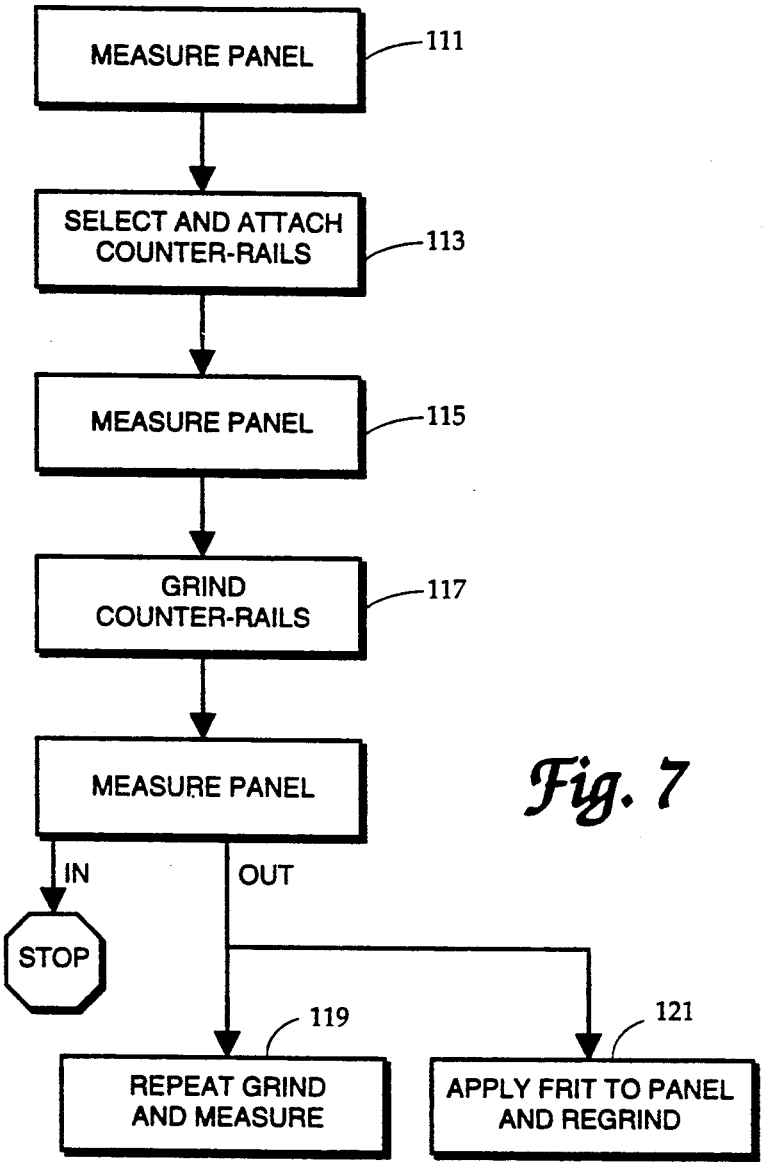
FIG. 7 is a block diagram of a method according to the present invention.

As illustrated in the block diagram of FIG. 7, a typical sequence for processing CRT front panels to attain a repeatable panel-to-panel curvature may include an initial panel flatness or distortion, measurement 111 prior to attaching the mask support rails or the counter-rails to aid in the selection of counter-rail composition or placement. The panel flatness may be measured by a commercially available machine such as a Cordax 3000 manufactured by Sheffield Co. of Dayton, Ohio. At the next step 113 the counter-rails 32 will be affixed to the panel 11 opposite the mask support rails 21 to over-warp the panel 11 outwardly. The panel 11 will then be measured as at 115 to make an initial determination of the amount of grinding to be done on the counter rail 21 to produce a balanced strain on the panel and produce the desired panel curvature or flatness.

Figure 8:
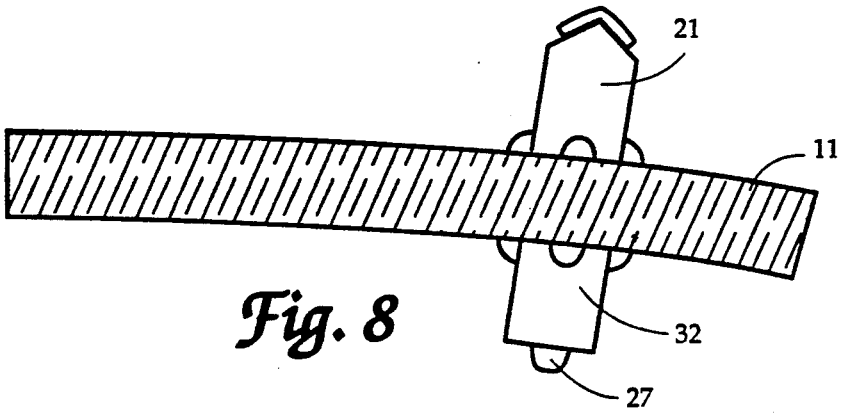
FIG. 8 illustrates a method of using a devitrifying frit as the strain-inducing structure.

The counter-rails 21 will then be ground as per box 117, as further discussed below. The measuring and grinding may be repeated as necessary 119. Also, should the counter rail be over-ground to an out-of-tolerance condition, as per FIG. 8, a bead of frit 27 may be reapplied to the counter rail 32 and devitrified to bring the panel 11 back to an outward distortion. The panel 11 would be remeasured and the frit bead 27 would then be ground to attain the desired degree of panel curvature. This process would eliminate the need to salvage the panel by removing all frit, a process which may damage the panel and render it useless.

The counter rail 32 is of a known height and in a known position to give a predetermined deformation strain to the panel. A known amount of counter rail mass is then removed by grinding the counter rail 32 with a grinding wheel 125 and measuring the rail height, "h", with a known device 127 such as disclosed in U.S. Pat. No. 4,828,524; commonly owned herewith, or other suitable means; as necessary. By removing a known amount of counter rail mass, according to its predictable behavior, a flat, or other desired, curvature of the panel 11 will be attained. It will be noted that where the counter-rails are placed on the outer surface 33 of panel 11, the grinding thereof may take place at any time during CRT assembly.

Figure 9:
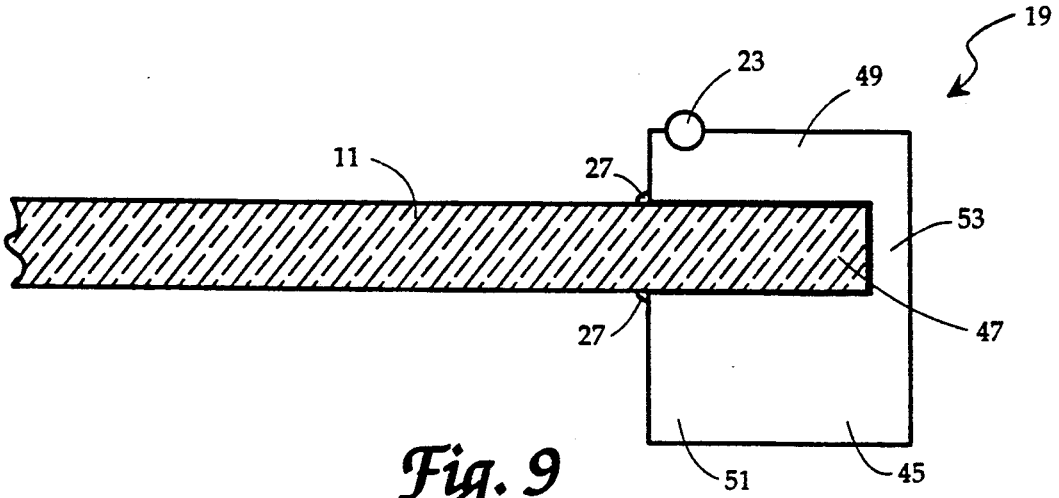
FIG. 9 illustrates an alternative strain-inducing structure embodiment for use with the present invention wherein the strain-inducing structure and the mask support means are combined in a unitary body.

As seen in FIG. 9, an alternative embodiment of the present invention includes mask support means 19 incorporated into a unitary cross "U"-shaped rail structure 45, or U-rail, which surrounds the edge 47 of the panel 11. The U-rail 45 is preferably composed of a ceramic material and is affixed over and to the panel edge 47 with a known devitrifying frit 27.

The U-rail 45 has first and second legs 49 and 51, respectively connected by a bight 53. Attached to the first leg 49, which is adjacent to the inner panel surface 13, is a metal strip, or wire 23 constructed and arranged for attachment of the shadow mask thereto as disclosed in the copending U.S. applications Ser. Nos. 07/566,721 and 07634,644, commonly owned herewith. It will be evident, from the foregoing disclosure, that the second leg 51, which is adjacent the outer panel surface 33, may be constructed and, if necessary, ground to counteract any undesirable panel distorting strain imparted to the panel 11 by the first leg 49 during attachment of the U-rail 45.

An advantage of the U-rail 45 embodiment of the present invention may include a savings of surface area on the panel inner surface 13 by locating the mask support means 19 outwardly from its normal position as shown in FIG. 3. A further advantage is the formation of a protective barrier around the panel edge 47, which is sensitive to physical contact during thermal processing of the panel 11 as disclosed and claimed in the aforementioned U.S. patent application Ser. No. 07/685,352; filing date, Apr. 15, 1991.

Figure 10:
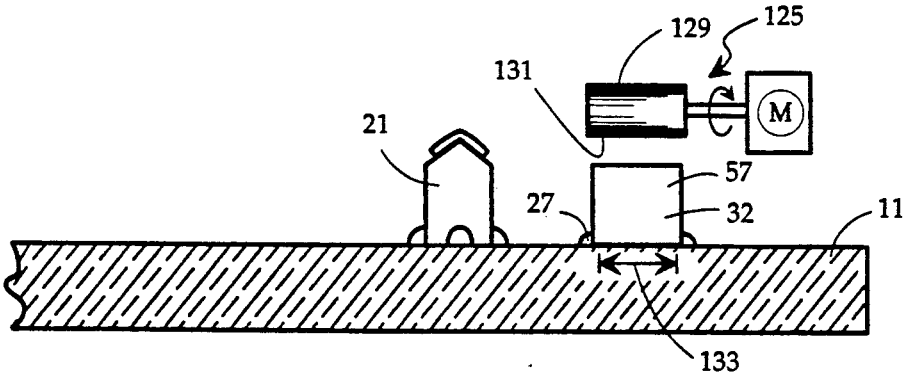
FIG. 10 illustrates an alternative strain-inducing structure embodiment, for use with the present invention, utilizing a high magnesia content structure located on the same side of the panel as the mask support means.

As seen in FIG. 10, a third embodiment of the invention includes a high magnesia content ceramic rail 57 affixed by frit 27 onto the panel inner surface 13 next to the mask support means 19. By raising the magnesia content of the rail 57 from the preferred 28% up to approximately 34%, the strain produced by the rail will tend to bow the panel outwardly instead of inwardly as will the standard rails 21. Thus the high magnesia content rail 57 may be used on the inner panel surface 13 as means to counteract the undesirable panel distortion caused by the mask support means. Such a placement of the counteracting means, while making the panel more susceptible to damage from thermal shock, and taking up space on the screen side of the panel, may be desirable where conditions do not allow placing the counteracting means on the outer surface 33, or front of the panel.

As seen in FIG. 10, a grinding apparatus 125 having a small grinding wheel 129 with an active surface 131 not significantly wider than the width 133 of the counter rail 32 may be constructed and arranged to traverse the counter-rails 32 and grind them without adversely affecting the mask support rails 21.

Figure 11:
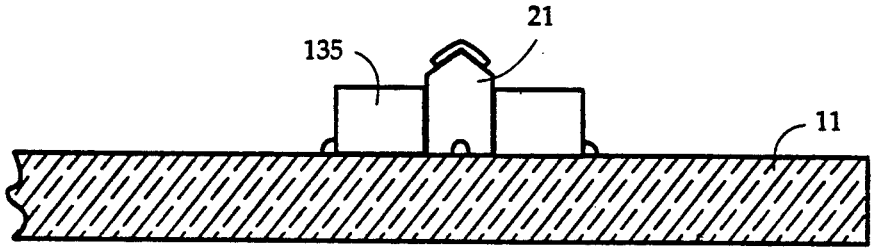
FIG. 11 illustrates mask support means having a strain inducing structure as an integral shoulder thereof.

Alternatively, as seen in FIG. 11, the mask support rail 21 may be equipped with extensions, or shoulders 135, of the same, or substantially similar, composition as the main rail 21 and located on the same side of the panel 11, which will produce a panel deflection of greater magnitude than ultimately desired for the finished panel. The shoulders 135 may then be ground with e.g., the small grinding wheel apparatus of FIG. 10, and measured, until the desired panel curvature is attained.

This arrangement is most suitable for use where a repeatable panel curvature of a fixed radius is desired, rather than a true flat faceplate illustrated in the other embodiments.

While the ceramic rails or their counterparts are described herein as distortion counteracting means, it will be evident to the artisan that rails may be constructed and arranged as the sole strain inducers and acted upon so as to more consistently control the panel curvature and not merely counteract undesirable distortion induced in the panel by the mask support rails and may be, used alone on in combination with other CRT elements or manufacturing apparatus to achieve their desired affect.

While the present invention has been illustrated and described in connection with the preferred embodiments, it is not to be limited to the particular structure shown, because many variations thereof will be evident to one skilled in the art and are intended to be encompassed in the present invention as set forth in the following claims:

Having thus described the invention, What is claimed is:

1. In a CRT glass front panel, the improvement comprising a body for controlling the panel curvature so as to achieve a desired predetermined panel configuration, the body being affixed to the glass panel; the body being shaped and composed of a material so as to induce strain to the panel sufficient to conform the panel to the desired configuration.

2. A CRT glass front panel comprising:

(a) shadow mask support means affixed to the front panel, the mask support means causing undesirable distortion of the front panel; and (b) means for counteracting the undesirable distortion of the front panel, the counteracting means also being affixed to the front panel; wherein:

the mask support means are affixed to a first front panel surface; and the counteracting means are affixed to a second front panel surface opposite the first surface.

3. The front panel of claim 2 wherein the counteracting means and the panel have different coefficients of thermal expansion.

4. The front panel of claim 2, wherein:

the mask support means and counteracting means are composed of substantially similar materials.

5. The front panel of claim 2, wherein:

the counteracting means has a lower coefficient of thermal expansion than the mask support means.

6. The front panel of claim 2, wherein:

the counteracting means has a substantially similar coefficient of thermal expansion to that of the mask support means.

7. The front panel of claim 2, wherein:

the mask support means and counteracting means are composed substantially of ceramic materials.

8. A CRT glass front panel comprising:

(a) shadow mask support means affixed to the front panel, the mask support means causing undesirable distortion of the front panel; and (b) means for counteracting the undesirable distortion of the front panel, the counteracting means also being affixed to the front panel; wherein: the mask support means and the counteracting means are connected together prior to affixation to the front panel.

9. A CRT glass front panel comprising:

(a) shadow mask support means affixed to the front panel, the mask support means causing undesirable distortion of the front panel; and (b) means for counteracting the undesirable distortion of the support means, the counteracting means also being affixed to the front panel, the counteracting means comprising a devitrifying frit.

10. In a CRT glass front panel having a transparent panel, the improvement comprising means for controlling the panel curvature so as to achieve a desired predetermined panel configuration, the controlling means being attached to the glass panel, the attached controlling means being composed of material having a different coefficient of thermal expansion than the panel.

* * * * *